US005300945A

United States Patent [19]

Iemoto et al.

[11] Patent Number: 5,300,945

[45] Date of Patent: Apr. 5, 1994

[54] DUAL OSCILLATING DRIVE CIRCUIT FOR A DISPLAY APPARATUS HAVING IMPROVED PIXEL OFF-STATE OPERATION

[75] Inventors: Takaaki Iemoto, Takaichi; Koji Kumada; Takashi Ohnishi, both of Tenri; Hideki Yakushigawa, Ikoma, all of Japan

[73] Assignee: Sharp Kabushiki Kaisha, Osaka, Japan

[21] Appl. No.: 896,100

[22] Filed: Jun. 10, 1992

[30] Foreign Application Priority Data

Jun. 10, 1991 [JP] Japan ..... 3-138028

[51] Int. Cl.[5] ..... G09G 3/36

[52] U.S. Cl. ..... 345/92; 359/57

[58] Field of Search ..... 340/765, 784, 805, 811; 359/57

[56] References Cited

U.S. PATENT DOCUMENTS 4,532,506 7/1985 Kitazima et al. ..... 340/805

FOREIGN PATENT DOCUMENTS

AA 0395387 10/1990 European Pat. Off. .

AB 0079496 5/1983 European Pat. Off. .

*Primary Examiner*—Jeffery Brier

*Attorney, Agent, or Firm*—David G. Conlin; Robert F. O'Connell

[57] ABSTRACT

A drive circuit for a display apparatus having a display section including a pixel, a switching element connected to the pixel and a scanning electrode connected to the switching element, and a pixel electrode and a counter electrode being provided on opposite sides of the pixel, includes a circuit for applying a first oscillating voltage to the counter electrode, and for applying a second oscillating voltage having the same phase and the same amplitude as the first oscillating voltage to the scanning electrode during a period when the switching element is to be in off-state.

7 Claims, 5 Drawing Sheets

DUAL OSCILLATING DRIVE CIRCUIT FOR A DISPLAY APPARATUS HAVING IMPROVED PIXEL OFF-STATE OPERATION

BACKGROUND OF THE INVENTION

1. Field of the Invention

The present invention relates to a drive circuit for a display apparatus, and more particularly to a drive circuit for driving a display section comprising a plurality of parallel signal electrodes and a plurality of parallel scanning electrodes crossing each other, pixel electrodes disposed near the respective crossings of the signal electrodes and the scanning electrodes, and a counter electrode facing the pixel electrodes.

In this specification, a matrix type liquid crystal display apparatus will be described as a typical example of a display apparatus, but this invention can also be applied to drive circuits for other types of display apparatus such as an electroluminescence (EL) display apparatus and a plasma display apparatus.

2. Description of the Prior Art

A conventional matrix type liquid crystal display apparatus is schematically shown in FIG. 7, which comprises a TFT liquid crystal panel 100 using thin film transistors (TFTs) 104 as switching elements for driving pixel electrodes 103 arranged in a matrix. The TFT liquid crystal panel 100 also comprises a plurality of scanning electrodes 101 disposed in parallel to one another, and a plurality of signal electrodes 102 disposed in parallel to one another so as to cross the scanning electrodes 101. The TFTs 104 for driving the pixel electrodes 103 are disposed near the respective crossings of the scanning electrodes 101 and the signal electrodes 102. A counter electrode 105 is disposed facing the pixel electrodes 103. In FIG. 7, the counter electrode 105 is schematically shown, but it is generally a conductive layer formed as a common counter electrode for all of the pixel electrodes. An oscillating voltage is applied to the counter electrode 105 so as to reduce amplitudes of signal voltages applied to the signal electrodes 102. Hereinafter, the oscillating voltage applied to the counter electrode 105 is referred to as a counter voltage.

The TFT liquid crystal panel 100 is driven by a drive circuit including a source driver 2 and a gate driver 3, which are connected to the signal electrodes 102 and the scanning electrodes 101, respectively. The source driver 2 samples analog image signals or analog video signals input thereto, holds the sampled signals, and then applies them to the signal electrodes 102. The gate driver 3 sequentially applies scanning pulses as drive signals to the scanning electrodes 101. Control signals such as timing signals are applied to the source driver 2 and the gate driver 3 by a control circuit 4.

FIG. 6 shows waveforms of scanning pulses supplied to the scanning electrodes 101 in a conventional matrix type liquid crystal display apparatus.

FIG. 3 shows a relationship between a scanning pulse applied to the scanning electrodes 101 and the counter voltage in a conventional drive circuit. As shown in FIG. 3, the scanning pulse takes a high-level value and a low-level value periodically. A period when the scanning pulse takes the high-level value is referred to as a "gate on period". A period when the scanning pulse takes the low-level value is referred to as a "gate off period". The counter voltage is applied to the counter electrode 105 during the gate on period and the gate off period.

Generally, the low-level value of the scanning pulse is lowered so as to ensure that the TFT 104 is completely in off-state during the gate off period. However, when the low-level value of the scanning pulse is excessively lowered, the TFT 104 can not be completely in off-state. As a result, it is difficult to secure the complete off-state of the TFT 104 during the gate off period.

Referring to FIGS. 4 and 5, the above problem will be described in detail. While the counter voltage is applied to the counter electrode 105, a voltage applied to a drain D of the TFT 104 varies by $\Delta V_x$ in the following expression:

$$\Delta V_x = \pm V_c/(1+C_{GD}/C_{LC})$$

wherein $\pm V_c$ represents the counter voltage which has an oscillating component, $C_{GD}$ represents a stray capacitance between a gate G and the drain D of the TFT 104, $C_{LC}$ represents a capacitance between the pixel electrode 103 and the counter electrode 105.

FIG. 5 shows a relationship between a voltage $V_g$ applied to the gate and a drain current $I_D$. As shown in FIG. 5, an optimal voltage to be applied to the gate to secure a complete off-state of the TFT 104 varies between voltages $V_L$ and $V_H$. This makes it difficult to set the low-level value of the scanning pulse to the optimal voltage during the gate off period. As a result, since the complete off-state of the TFT 104 can not be secured, a deterioration of the liquid crystal elements occurs, and a reliability of the display apparatus is lowered.

The objective of the present invention is to provide a drive circuit for a display apparatus which ensures that pixel electrodes of the display apparatus are completely put into the non-driving state when the pixel electrodes are not driven (i.e. during the gate off period) and the non-driving state is sustained for a long period, thereby preventing a deterioration of the display apparatus.

SUMMARY OF THE INVENTION

The drive circuit of this invention is applicable for a display apparatus having a display section including a pixel, a switching element connected to said pixel and a scanning electrode connected to said switching element, and a pixel electrode and a counter electrode being provided on the opposite sides of said pixel. The drive circuit comprises a first means for applying a first oscillating voltage to said counter electrode and a second means for applying a second oscillating voltage having the same phase and the same amplitude as said first oscillating voltage to said scanning electrode during a period when said switching element is to be in off-state.

According to another aspect of the present invention, a display apparatus is provided which comprises a display section including a pixel, a switching element connected to said pixel and a scanning electrode connected to said switching element, and a pixel electrode and a counter electrode being provided on the opposite sides of said pixel and a drive circuit for driving said display section, including a first means for applying a first oscillating voltage to said counter electrode, and a second means for applying a second oscillating voltage having the same phase and the same amplitude as said first oscillating voltage to said scanning electrode during a period when said switching element is to be in off-state.

In one embodiment, said second means selectively applies said second oscillating voltage having the same phase and the same amplitude as said first oscillating voltage and a third oscillating voltage having the same phase as said first oscillating voltage to said scanning electrode, depending on whether said switching element is to be in off-state or in on-state.

In another embodiment, said switching element is a thin film transistor (TFT).

In still another aspect of the present invention, there is provided a method of driving a display apparatus having a display section including a pixel, a switching element connected to said pixel and a scanning electrode connected to said switching element, and a pixel electrode and a counter electrode being provided on the opposite sides of said pixel, said method comprising the steps of applying a first oscillating voltage to said counter electrode and applying a second oscillating voltage having the same phase and the same amplitude as said first oscillating voltage to said scanning electrode during a period when said switching element is to be in off-state.

Thus, the invention described herein makes possible the objective of providing a drive circuit for a display apparatus which ensures that pixel electrodes of the display apparatus are practically put into the non-driving state when the pixel electrodes are not driven (i.e. during the gate off period), thereby preventing a deterioration of the display apparatus and improving a reliability thereof.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENT

Figure 1:
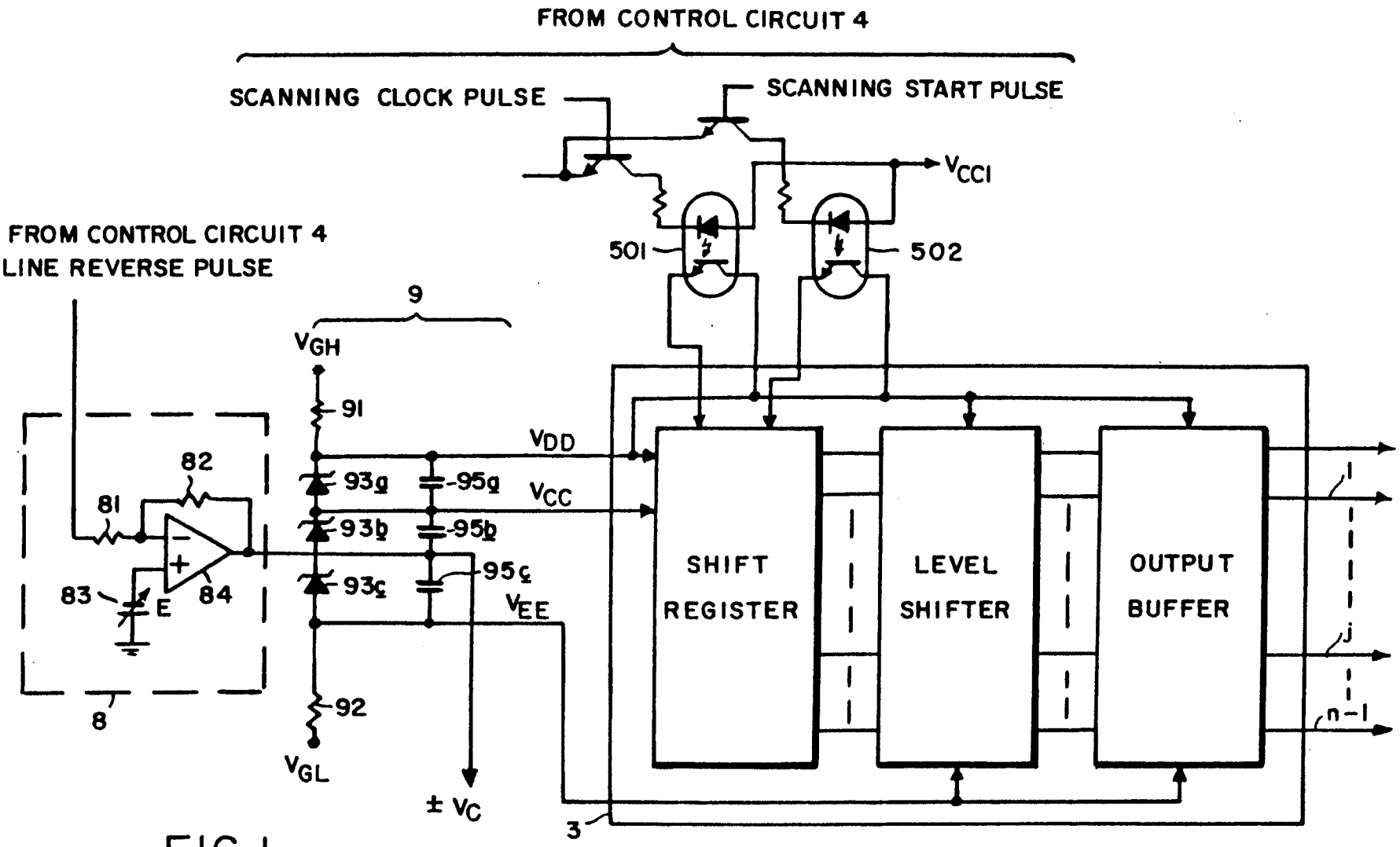
FIG. 1 is a circuit diagram showing an embodiment of a drive circuit according to the present invention.
Figure 7:
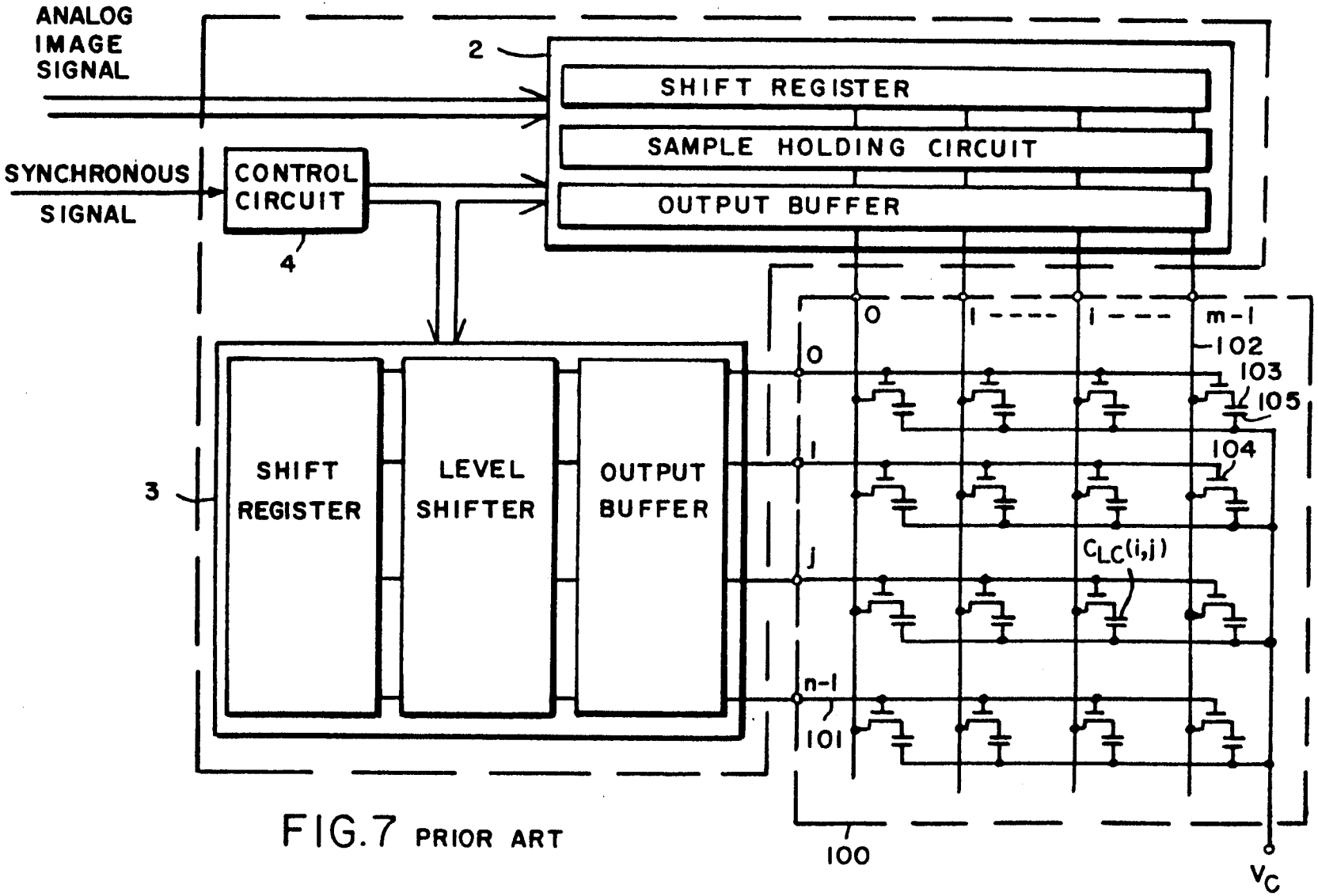
FIG. 7 PRIOR ART
FIG. 7 shows a configuration of a conventional liquid crystal display apparatus.

FIG. 1 shows a configuration of a portion around a gate driver 3 of a drive circuit as one embodiment according to the present invention. The configuration of this embodiment other than the portion shown in FIG. 1 can be the same as that shown in FIG. 7.

As shown in FIG. 1, an voltage output from a counter voltage generating circuit 8 is not only used as a counter voltage similarly in the conventional drive circuit, but also used as a voltage input to an electric source circuit 9. The electric source circuit 9 supplies a plurality of operational voltages to the gate driver 3. The counter voltage generating circuit 8 includes an amplifier 84. A reverse input terminal of the amplifier 84 receives line reverse pulses from a control circuit 4 through a resistance 81, while a non-reverse input terminal thereof is connected to a source 83 for supplying a variable direct-current (DC). The counter voltage $\pm V_c$ which oscillates with a desired amplitude can be obtained by setting the values of the resistance 81 and a resistance 82 appropriately.

The electric source circuit 9 includes a sequential circuit composed of a resistance 91, three Zener diodes 93*a* to 93*c*, and a resistance 92. One end of the sequential circuit on the side of the resistance 91 is connected to a source for supplying a high-level gate voltage $V_{GH}$. The other end of the sequential circuit on the side of the resistance 92 is connected to a source for supplying a low-level gate voltage $V_{GL}$. An output terminal of the amplifier 84 is connected to a node of the Zener diodes 93*b* and 93*c*.

The electric source circuit 9 further includes another sequential circuit composed of three capacitors 95*a* to 95*c* which are connected in parallel to the Zener diodes 93*a* to 93*c*. More specifically, one end of the capacitor 95*a* is connected to a node of the resistance 91 and the Zener diode 93*a*. A node of the capacitors 95*a* and 95*b* is connected to a node of the Zener diodes 93*a* and 93*b*, a node of the capacitors 95*b* and 95*c* is connected to a node of the Zener diodes 93*b* and 93*c*, and the other end of the capacitor 95*c* is connected to a node of the Zener diode 93*c* and the resistance 92. It is supposed that the Zener voltages of the Zener diodes 93*a*, 93*b* and 93*c* are $V_{Z1}$, $V_{Z2}$ and $V_{Z3}$, respectively.

In the above-described configuration, three types of voltage pulses $V_{DD}$, $V_{CC}$ and $V_{EE}$ ($V_{DD}>V_{CC}>V_{EE}$) are output from the electric source circuit 9 to the gate driver 3. The voltage pulse $V_{CC}$ is only used for the logical control of the gate driver 3 and not applied to the scanning electrode 101.

Figure 2A:
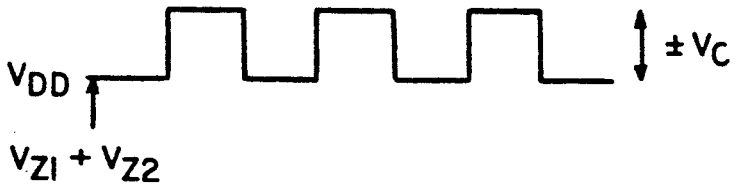
FIGS. 2*a*, 2*b* and 2*c* show signal waveforms for the embodiment of FIG. 1.
Figure 2B:
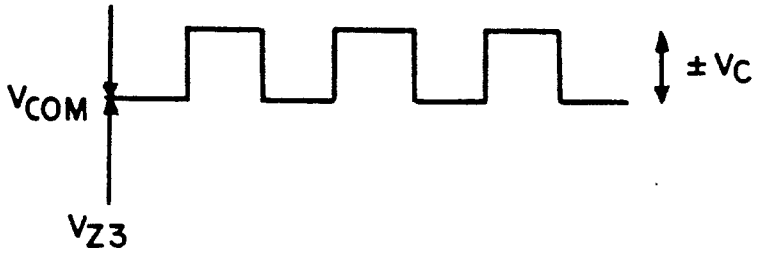
Figure 2C:
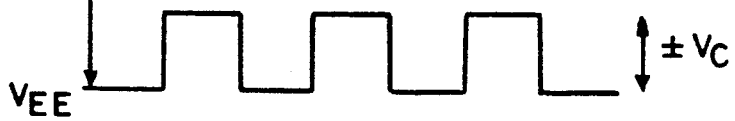

FIGS. 2*a* and 2*c* show waveforms of the voltage pulses $V_{DD}$ and $V_{EE}$, respectively. FIG. 2*b* shows a waveform of a counter voltage $V_{COM}$ for driving the counter electrode 101. The voltage pulse $V_{DD}$ and the voltage pulse $V_{EE}$ are pulse signals which oscillate with the same phase and the same amplitude as the counter voltage $V_{COM}$. In FIGS. 2*a*, 2*b* and 2*c*, $V_{Z1}+V_{Z2}$ represents a potential difference between the voltage pulse $V_{DD}$ and the counter voltage $V_{COM}$. $V_{Z3}$ represents a potential difference between the voltage pulse $V_{EE}$ and the counter voltage $V_{COM}$.

Scanning clock pulses and scanning start pulses as control signals are supplied to the gate driver 3 from the control circuit 4 through photocouplers 501 and 502, respectively.

The gate driver 3 applies the voltage pulse $V_{DD}$ or $V_{EE}$ as a scanning pulse to the scanning electrode 101 at the same timing as in a conventional gate driver. More specifically, the voltage pulse $V_{DD}$ is selected during a period when the TFT 104 connected to the scanning electrode 101 is to be in on-state (i.e. the gate on period), and applied to the scanning electrode 101. On the other hand, the voltage pulse $V_{EE}$ is selected during a period when the TFT 104 is to be in off-state (i.e. the gate off period), and applied to the scanning electrode 101.

Figure 2D:
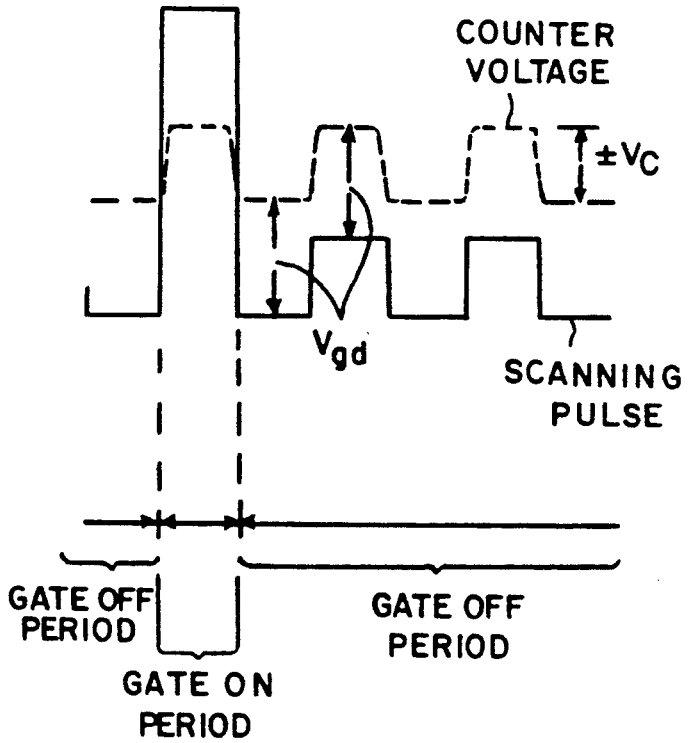
FIGS. 2*d* shows a relationship between a scanning pulse and a counter voltage.
Figure 3:
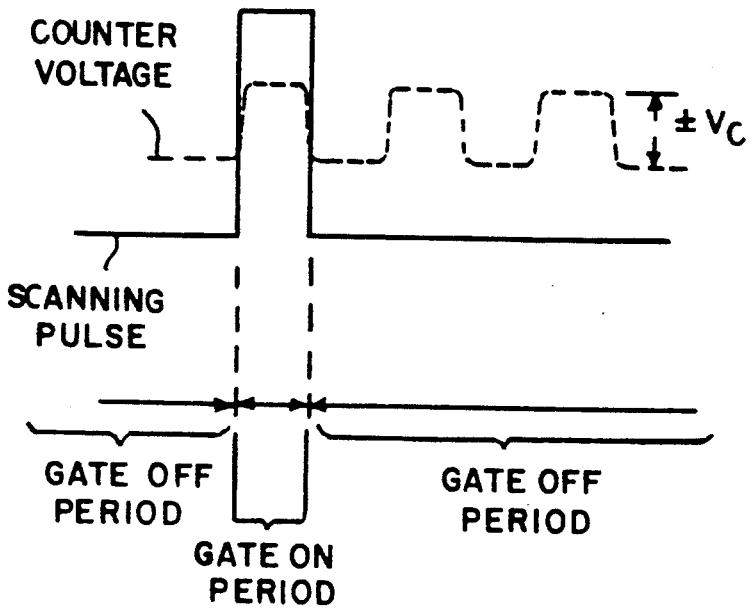
FIG. 3 PRIOR ART
FIG. 3 shows a relationship between a scanning pulse and a counter voltage in a conventional drive circuit.
Figure 4:
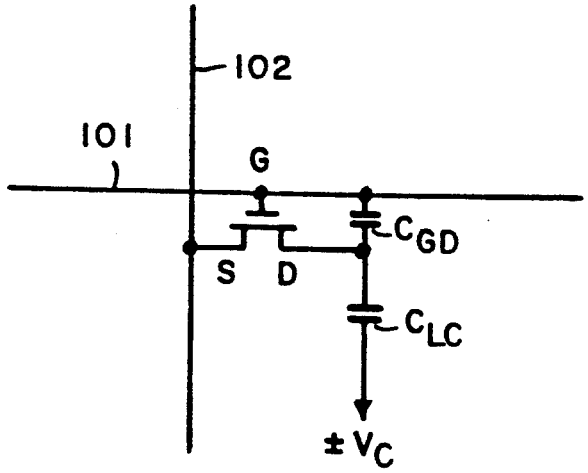
FIG. 4 is an equivalent circuit diagram of a portion around a pixel electrode of a display apparatus.
Figure 5:
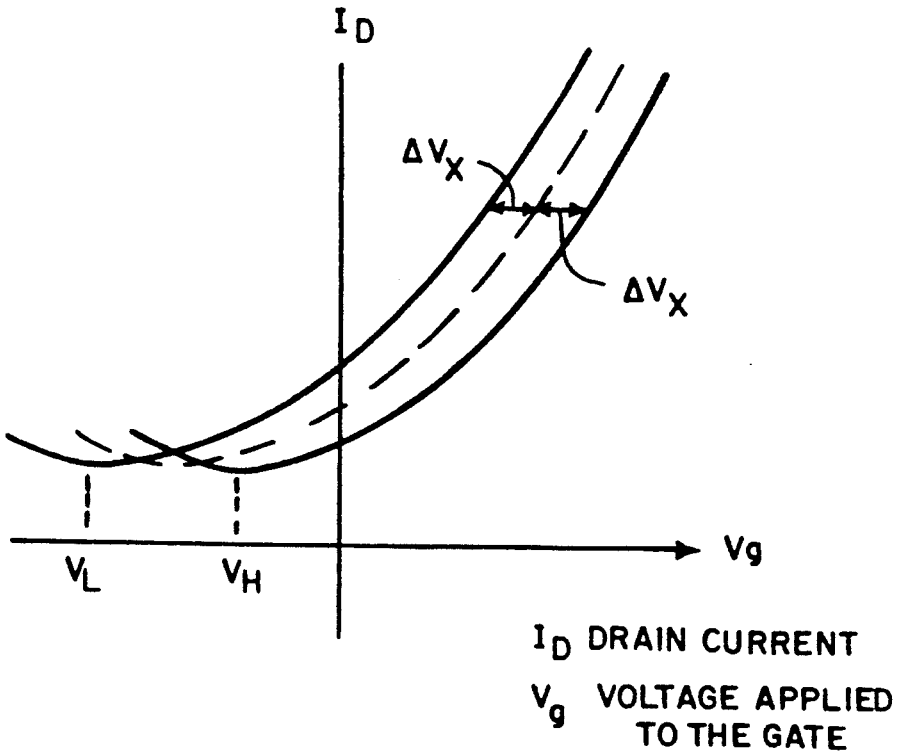
FIG. 5 is a graph showing a relationship between a voltage applied to a gate of a TFT and a drain current in a conventional display apparatus.
Figure 6:
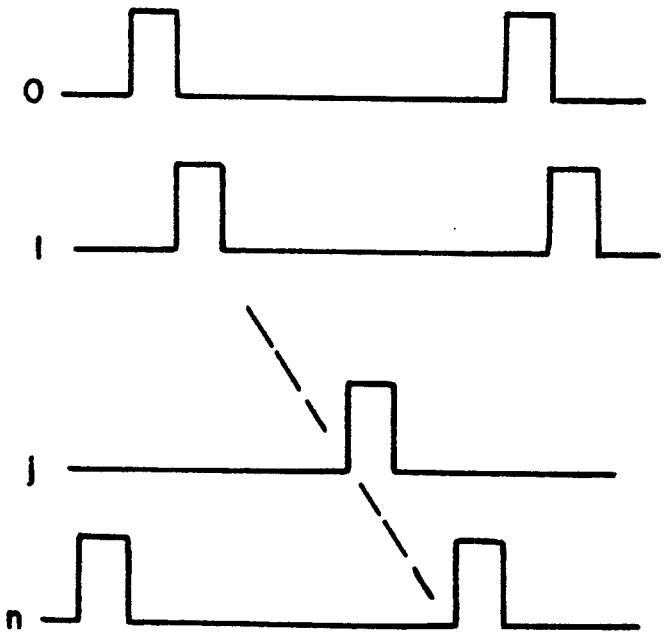
FIG. 6 PRIOR ART
FIG. 6 shows scanning pulses applied to scanning electrodes.

FIG. 2*d* shows a waveform of a scanning pulse generated by the voltage pulse $V_{DD}$ and the voltage pulse $V_{EE}$ being selectively applied in the above-mentioned manner. The scanning pulse may be generated by selectively superposing the voltages $V_{EE}$ and $V_{DD}$ upon a scanning pulse given in the conventional drive circuit.

As shown in FIG. 2d, the scanning pulse (shown by the solid line) during the off period has the same phase and the same amplitude as that of the counter voltage (shown by the dotted line). Since a potential difference $V_{gd}$ between the scanning pulse and the counter voltage is kept constant during the gate off period, the potential variation $\pm V_c/(1+C_{GD}/C_{LC})$ at the drain caused by the counter voltage given in the conventional drive circuit is stabilized. As a result, the optimal voltage applied to the gate of the TFT 104 is determined from the potential difference $V_{gd}$. Thus, it is possible to apply the optimal voltage so as to secure the complete off-state of the TFT 104. The potential difference $V_{gd}$ can be set to an arbitrary value by changing the Zener voltage $V_{Z3}$.

The above configuration of the present invention can also be applied to a drive circuit for a display apparatus provided with auxiliary capacitances formed near the pixel electrodes and a display apparatus for an office automation system.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A drive circuit for a display apparatus having a display section including a pixel, a switching element connected to said pixel and a scanning electrode connected to said switching element through a gate electrode of the switching element, and a pixel electrode and a counter electrode being provided on opposite sides of said pixel, said drive circuit comprising:

a first means for applying a first oscillating voltage to said counter electrode; and a second means for applying a second oscillating voltage having the same phase and the same amplitude as said first oscillating voltage to said scanning electrode during a period when said switching element is to be in an off-state;

said second means applying a third voltage to said scanning electrode during a period when said switching element is to be in an on-state, said third voltage being larger than said second oscillating voltage.

2. A drive circuit for a display apparatus according to claim 1, wherein said second means selectively applies said second oscillating voltage having the same phase and the same amplitude as said first oscillating voltage, and wherein said second means selectively applies a fourth oscillating voltage having the same phase as said first oscillating voltage to said scanning electrode, depending on whether said switching element is to be in an on-state, and said first means and said second means are connected.

3. A display apparatus comprising:

a display section including a pixel, a switching element connected to said pixel and a scanning electrode connected to said switching element, and a pixel electrode and a counter electrode being provided on opposite sides of said pixel; and a drive circuit for driving said display section, including a first means for applying a first oscillating voltage to said counter electrode, and a second means for applying a second oscillating voltage having the same phase and the same amplitude as said first oscillating voltage to said scanning electrode during a period when said switching element is to be in an off-state;

said second means applying a third voltage to said scanning electrode during a period when said switching element is to be in an on-state, said third voltage being larger than said second oscillating voltage.

4. A display apparatus according to claim 3, wherein said second means selectively applies said second oscillating voltage having the same phase and the same amplitude as said first oscillating voltage and applies a third voltage having the same phase as said first oscillating voltage to said scanning electrode, depending on whether said switching element is to be in an off-state or in an on-state.

5. A display apparatus according to claim 3, wherein said switching element is a thin film transistor (TFT).

6. A method of driving a display apparatus having a display apparatus having a display section including a pixel, a switching element connected to said pixel and a scanning electrode connected to said switching element through a gate electrode of the switching element, and a pixel electrode and a counter electrode being provided on opposite sides of said pixel, said method comprising the steps of:

applying a first oscillating voltage to said counter electrode;

applying a second oscillating voltage having the same phase and the same amplitude as said first oscillating voltage to said scanning electrode during a period when said switching element is to be in an off-state; and applying a third voltage to said scanning electrode during a period when said switching element is to be in an on-state, said third voltage being larger than said second oscillating voltage.

7. A drive circuit for a display apparatus having a display section including a pixel, a switching element connected to said pixel and a scanning electrode connected to said switching element through a gate electrode of the switching element, and a pixel electrode and a counter electrode being provided on opposite sides of said pixel, said drive circuit comprising:

a first means for applying a first oscillating voltage to said counter electrode; and a second means for applying a second oscillating voltage having the same phase and the same amplitude as said first oscillating voltage to said scanning electrode during a period when said switching element is to be in an off-state;

said second means applying a third voltage to said scanning electrode during a period when said switching element is to be in an on-state, said third voltage being larger than said second oscillating voltage, wherein the difference between said second oscillating voltage and said first oscillating voltage is small enough to secure an off-state of said switching element.

* * * * *